US008876172B2

(12) United States Patent
Denison et al.

(10) Patent No.: US 8,876,172 B2
(45) **Date of Patent: *Nov. 4, 2014**

(54) VENDING MACHINE LOCK WITH MOTOR CONTROLLED SLIDE-BAR AND HOOK MECHANISM AND ELECTRONIC ACCESS

(75) Inventors: William Denison, Lake Zurich, IL (US); Gary L. Myers, Monee, IL (US); Richard Paeth, St. Charles, IL (US); Catalin Captarencu, Wheeling, IL (US); Calin V. Roatis, Long Grove, IL (US)

(73) Assignee: TriTeq Lock and Security, LLC, Elk Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/102,439

(22) Filed: Apr. 8, 2005

(65) Prior Publication Data

US 2006/0179900 A1 Aug. 17, 2006

Related U.S. Application Data

(63) Continuation-in-part of application No. 11/073,184, filed on Mar. 3, 2005, now abandoned.

(60) Provisional application No. 60/550,801, filed on Mar. 5, 2004, provisional application No. 60/618,069, filed on Oct. 12, 2004.

(51) Int. Cl.

| | |
|---|---|
| ***E05C 1/06*** | (2006.01) |
| ***E05B 47/02*** | (2006.01) |
| ***G07F 5/26*** | (2006.01) |
| *E05B 47/00* | (2006.01) |

(52) U.S. Cl.

CPC ..... *G07F 5/26* (2013.01); *E05B 47/026* (2013.01); *E05B 47/0012* (2013.01)

USPC ..... 292/144; 292/199; 70/257; 70/280

(58) Field of Classification Search

USPC ..... 70/257, 118, 190, 275, 277, 278.1, 70/278.7, 256, 279.1–282; 292/144, 199, 292/32, 39, 38, 160, 141, 279, 150, 292/DIG. 25, 86, 119, 125, DIG. 46; 109/59 R; 49/28

See application file for complete search history.

(56) References Cited

U.S. PATENT DOCUMENTS 3,521,920 A * 7/1970 Morand ..... 292/39
4,031,434 A 6/1977 Perron et al.

(Continued)

FOREIGN PATENT DOCUMENTS

FR 2667105 A1 * 3/1992
JP 3266096 A * 3/1990

OTHER PUBLICATIONS

Computer Generated Translation for FR 2667105, http://ep.espacenet.com/.*

(Continued)

*Primary Examiner* — Kristina Fulton
*Assistant Examiner* — Alyson M Merlino
(74) *Attorney, Agent, or Firm* — Miller, Matthias & Hull LLP

(57) ABSTRACT

An enhanced slide and hook locking mechanism control system for vending machines and the like that utilizes a reversible motor and worm gear drive that operates the slide and hook mechanism. The worm drive is coupled to the slide through a crankshaft type of interconnection. Or as alternatives, the slide means can be gear driven or it may be connected using push-pull type of cable or rod. An electronic control with a microcomputer interface drives the motor control and the system may be operated by a keypad or a remote wireless control device.

46 Claims, 12 Drawing Sheets

(56) References Cited

U.S. PATENT DOCUMENTS

| | | | | | |
|---|---|---|---|---|---|
| 4,167,104 | A | | 9/1979 | Bond | |
| 4,227,723 | A | * | 10/1980 | Rosell | 292/34 |
| 4,268,076 | A | | 5/1981 | Itoi | |
| 4,342,354 | A | * | 8/1982 | Leivenzon et al. | 160/133 |
| 4,369,442 | A | | 1/1983 | Werth et al. | |
| 4,500,122 | A | * | 2/1985 | Douglas | 292/161 |
| 4,509,093 | A | | 4/1985 | Stellberger | |
| 4,594,637 | A | | 6/1986 | Falk | |
| 4,779,090 | A | | 10/1988 | Micznik et al. | |
| 4,917,022 | A | | 4/1990 | Ogasawara et al. | |
| 4,926,996 | A | | 5/1990 | Eglise et al. | |
| 4,943,757 | A | * | 7/1990 | Richter et al. | 318/468 |
| 4,993,247 | A | | 2/1991 | Minemura | |
| 5,035,452 | A | * | 7/1991 | Rogers | 292/125 |
| 5,120,094 | A | * | 6/1992 | Eaton et al. | 292/159 |
| 5,148,691 | A | * | 9/1992 | Wallden | 70/279.1 |
| 5,199,288 | A | * | 4/1993 | Merilainen et al. | 70/279.1 |
| 5,253,903 | A | * | 10/1993 | Daley | 292/39 |
| 5,339,250 | A | | 8/1994 | Durbin | |
| 5,349,345 | A | | 9/1994 | Vanderschel | |
| 5,392,025 | A | | 2/1995 | Figh et al. | |
| 5,394,718 | A | * | 3/1995 | Hotzl | 70/283.1 |
| 5,404,737 | A | * | 4/1995 | Hotzl | 70/279.1 |
| 5,537,013 | A | * | 7/1996 | Toyozumi et al. | 318/283 |
| 5,542,720 | A | * | 8/1996 | Fleming | 292/32 |
| 5,575,515 | A | | 11/1996 | Iwamoto et al. | |
| 5,617,082 | A | | 4/1997 | Denison et al. | |
| 5,636,881 | A | | 6/1997 | Stillwagon | |
| 5,689,160 | A | * | 11/1997 | Shigematsu et al. | 318/281 |
| 5,745,044 | A | | 4/1998 | Hyatt, Jr. et al. | |
| 5,774,053 | A | | 6/1998 | Porter | |
| 5,813,257 | A | | 9/1998 | Claghorn et al. | |
| 5,841,866 | A | | 11/1998 | Bruwer et al. | |
| 5,850,753 | A | * | 12/1998 | Varma | 70/278.7 |
| 5,862,693 | A | | 1/1999 | Myers et al. | |
| 6,003,910 | A | * | 12/1999 | Dupont et al. | 292/201 |
| 6,005,487 | A | | 12/1999 | Hyatt, Jr. et al. | |
| 6,038,491 | A | | 3/2000 | McGarry et al. | |
| 6,068,305 | A | | 5/2000 | Myers et al. | |
| 6,116,067 | A | | 9/2000 | Myers et al. | |
| 6,185,773 | B1 | | 2/2001 | Goedde | |
| 6,282,931 | B1 | * | 9/2001 | Padiak et al. | 70/279.1 |
| 6,318,137 | B1 | | 11/2001 | Chaum | |
| 6,345,522 | B1 | | 2/2002 | Stillwagon et al. | |
| 6,359,547 | B1 | * | 3/2002 | Denison et al. | 340/5.73 |
| 6,401,059 | B1 | | 6/2002 | Shen et al. | |
| 6,483,424 | B1 | | 11/2002 | Bianco | |
| 6,496,101 | B1 | | 12/2002 | Stillwagon | |
| 6,525,644 | B1 | | 2/2003 | Stillwagon | |
| 6,575,504 | B2 | | 6/2003 | Roatis et al. | |
| 6,580,355 | B1 | * | 6/2003 | Milo | 340/5.7 |
| 6,581,986 | B2 | | 6/2003 | Roatis et al. | |
| 6,637,784 | B1 | * | 10/2003 | Hauber et al. | 292/300 |
| 6,658,905 | B1 | * | 12/2003 | Hsieh | 70/279.1 |
| 6,684,671 | B2 | | 2/2004 | Beylotte et al. | |
| 6,867,685 | B1 | | 3/2005 | Stillwagon | |
| 6,874,828 | B2 | | 4/2005 | Roatis et al. | |
| 7,009,352 | B2 | * | 3/2006 | Yamamoto et al. | 318/466 |
| 7,059,159 | B2 | * | 6/2006 | Lanigan et al. | 70/280 |
| 7,109,677 | B1 | * | 9/2006 | Gagnon et al. | 318/466 |
| 7,127,847 | B2 | * | 10/2006 | Fitzgibbon et al. | 49/28 |
| 7,132,813 | B2 | * | 11/2006 | Gregori et al. | 318/466 |
| 2002/0014950 | A1 | | 2/2002 | Ayala et al. | |
| 2002/0017793 | A1 | * | 2/2002 | Spiessl | 292/341.16 |
| 2002/0024418 | A1 | | 2/2002 | Ayala et al. | |
| 2002/0024420 | A1 | | 2/2002 | Ayala et al. | |
| 2002/0083747 | A1 | * | 7/2002 | Beylotte et al. | 70/257 |
| 2002/0157313 | A1 | * | 10/2002 | Fukazawa et al. | 49/26 |
| 2003/0030539 | A1 | | 2/2003 | McGarry et al. | |
| 2003/0094023 | A1 | * | 5/2003 | Emiel Van Parys | 70/257 |
| 2003/0127866 | A1 | | 7/2003 | Martinez et al. | |
| 2003/0128101 | A1 | | 7/2003 | Long | |
| 2003/0234719 | A1 | | 12/2003 | Denison et al. | |
| 2005/0193629 | A1 | * | 9/2005 | Tsui et al. | 49/26 |
| 2005/0248163 | A1 | * | 11/2005 | Kim | 292/201 |

OTHER PUBLICATIONS

U.S. Appl. No. 60/523,505, filed Nov. 18, 2003, Denison et al.
U.S. Appl. No. 11/073,184, filed Mar. 3, 2005, Denison et al.
U.S. Appl. No. 11/248,314, filed Oct. 12, 2005, Denison et al.

* cited by examiner

Unlocked to Locked Transition

Locked to Unlocked Transition with Options

Unlocked to Locked Transition with Options

VENDING MACHINE LOCK WITH MOTOR CONTROLLED SLIDE-BAR AND HOOK MECHANISM AND ELECTRONIC ACCESS

RELATED APPLICATIONS

This application claims priority to U.S. Provisional Application No. 60/618,069, filed Oct. 12, 2004, and incorporates the same by reference in its entirety. It is also related to U.S. Provisional Application No. 60/550,801, filed Mar. 5, 2004, now application Ser. No. 11/073,184, filed Mar. 3, 2005.

FIELD OF THE INVENTION

The present invention relates generally to vending machine lock systems that control the movement of the slide and hook mechanism such as in a conventional snack food or glass-front vending machine. More specifically the invention provides an enhanced slide mechanism control, and it may also incorporate a unique access control device such as a keypad access control and/or a remote control device that transmits codes in a wireless medium.

BACKGROUND OF THE INVENTION

Snack food and glass-front vending machines today are typically secured with a mechanism comprising of a slide-bar and hooks or the like in the door, which generally extend into the cabinet frame when locked, the motion going from unlocked to locked is typically controlled by a rotatable exterior mounted handle controlled by a mechanical T-handle mechanism, see Minemura U.S. Pat. No. 4,993,247. The handle is prevented from rotating by a mechanical core lock. For example, a slide-bar configuration consisting of one or more bars that is in a retracted position while the door is open and as the door is being closed. Once the door is in the closed position, the operator takes the handle and rotates it typically 90 or 180 degrees (depending on the geometry of the hooks) and the hooks will extend into the catches in the cabinet. To unlock, first the access control device is accessed, the slide-bar and the hooks are moved retracted from the catches, and last the handle is pulled so the door will open. These methods are typically cumbersome and time consuming. In addition, an enclosure as described above will typically have an unattractive looking handle and dial or keypad lock mounted to the exterior of the door.

The object of this invention is to improve on the methods, operation, and the interface of the vending machine locking and the unlocking as described above. In addition, the removal of certain components from the outside of the enclosure door will add to the improvements mentioned by providing enhanced security due to a more difficult point of attack and also provide additional exterior surface area to add decorative features to the vending machine door.

This invention is not limited to any particular type, style or application of the enclosure. In addition, although the preferred embodiment of the invention will describe a door with slide bar and hook mechanism interfacing to catches in the cabinet of the enclosure, this invention will also support the opposite arrangement such as a slide bar and hook mechanism in a cabinet that interface into catches in the doorframe, as well as many other types of door, cabinet, and mechanism arrangements as are available. This invention will also support the opposite mechanism arrangement such as (for example) a motor controlling a slide bar consisting of catches (instead of hooks) which would latch and un-latch into one or more hooks (instead of catches). A cable or rod may be used to interface the lock mechanism to the slide bar. In the case of a rod being used it can also be modified to act as the latch itself.

BRIEF SUMMARY OF THE OBJECTS OF THE INVENTION

The first object is to improve the locking and unlocking of the door by removing the need for a handle interfaced to a slide-bar hook mechanism.

The second object is to replace manual movement of the slide-bar with motor control movement of the slide-bar.

The third object is to provide a less user interactive procedure and an easier interface to access and lock the vending machine.

The forth object is to provide a faster method for accessing and locking the vending machine.

The fifth object is to improve the security of the door and remove the point of attack by removing the need for an access control unit (T-handle and lock core) from the door and replace with an electronic remote or removable keypad transmission device.

The sixth object is to provide a more user-friendly electronic controlled device to access and lock the door.

The seventh object is to provide the above-described features with a device that is battery powered, although the invention is not limited to battery controlled operation.

BRIEF DESCRIPTION OF THE DRAWINGS

FIG. 3 A is a perspective view of an alternate configuration of the mechanism showing how the helical gear can act as a direct interface for the slide assembly;

DETAILED DESCRIPTION OF THE INVENTION

Figure 1:
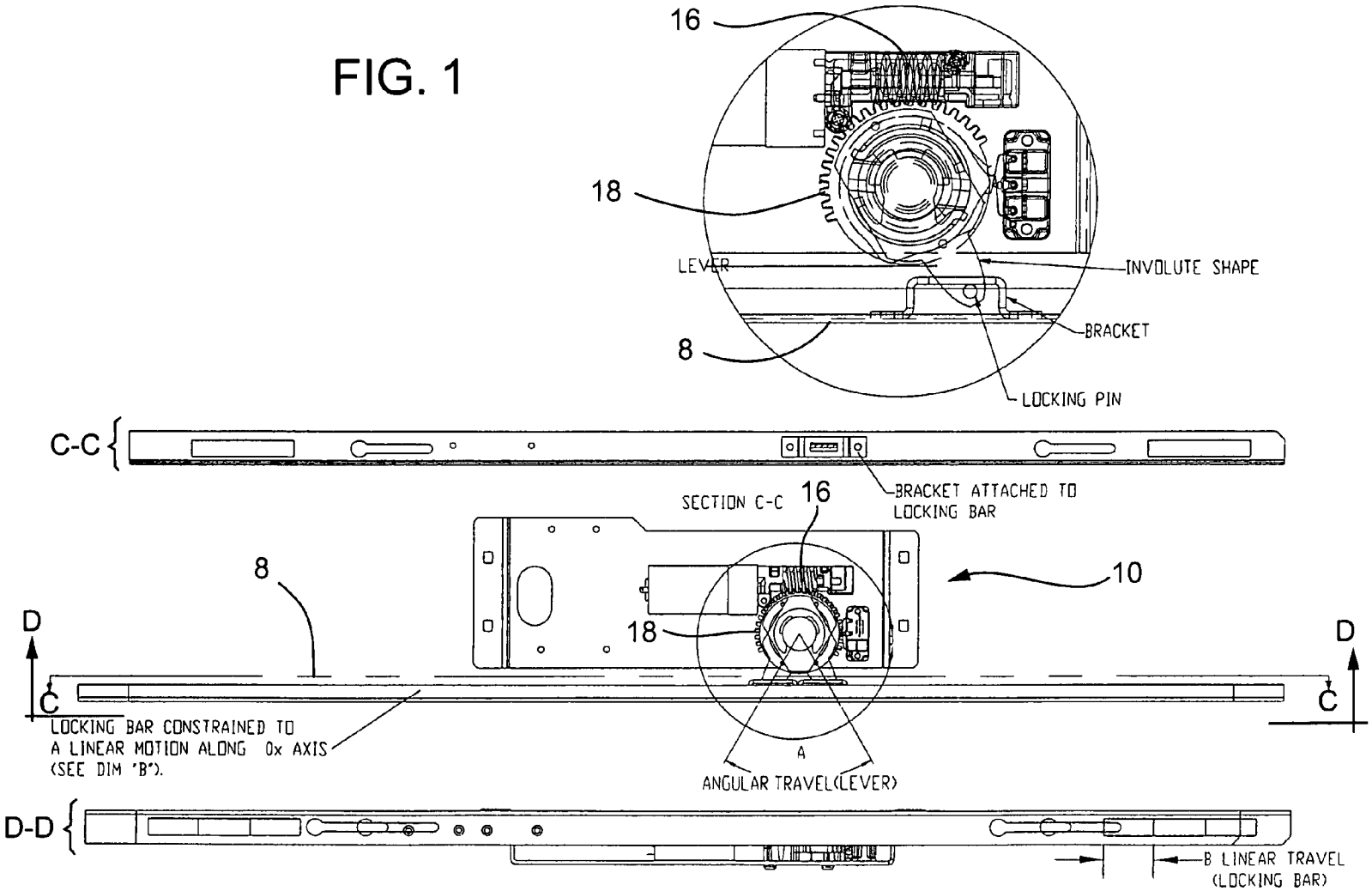
FIG. 1 is an elevational view of the present motor-controlled slide-bar mechanism together with broken out and detail enlarged views taken along the line C-C and for the area D and here showing how it interfaces to the lock-bar.
Figure 2:
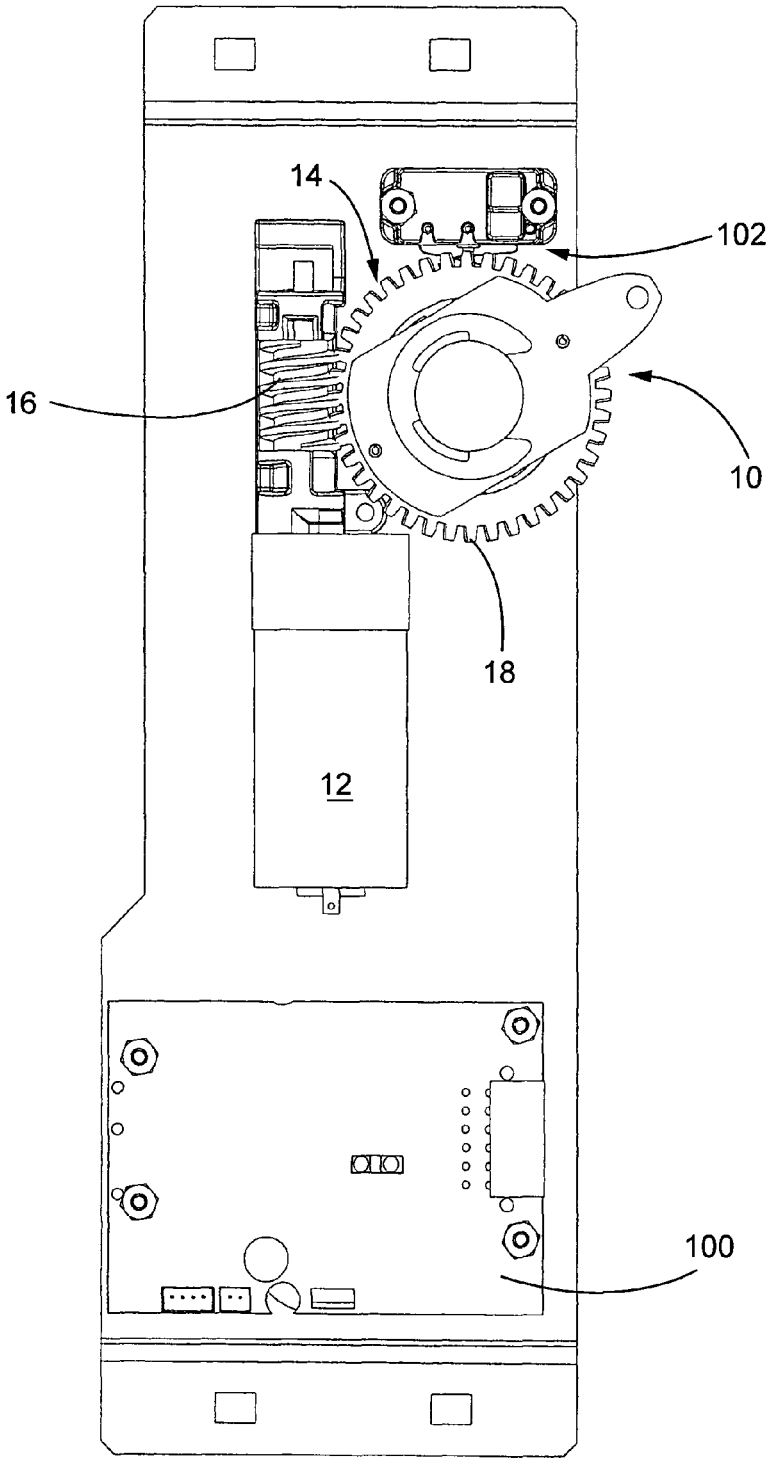
FIG. 2 is a front plan view of the motor controlled slide-bar mechanism locking system.

The prior art is illustrated in U.S. Pat. No. 4,993,247. It would typically consist of a T-handle, a slide-bar mechanism, and the interface of these components. Electronic locking systems are shown in Roatis et al. U.S. Pat. Nos. 6,581,986 and 6,575,504, for example, as used with ordinary lighted doors used on vending machines. Glass front doors can use a locking system similar to a school locker wherein a sliding bar having slots or hooks engage with complimentary slots or hooks.

This invention consists primarily of a motor controlled mechanism to control the movement of the slide-bar mechanism 8 in a vending machine or the like; an electronic control interface to the motor mechanism, an access control device, and a power source.

The motor controlled mechanism 10 is shown in drawing FIGS. 1, 2, 3, 3A and 3B. It serves to eliminate the handle drive system in vending machines, as they exist today. The motorized lock 10 provides a motor 12 to gear reduction 14 system that allows adequate power to control and move the mechanism, and also will hold back several hundreds of pounds of pry pressure if a vandal were to attempt to pry or force a locked mechanism back to the unlocked position by using a pry bar or other tool to push the extended slide-bar back to the retracted position. This is accomplished by gear reducing the motor rotation first through smaller metal gears in the motor mounted gearbox then to a worm-gear 16 to helical gear arrangement 18. The helical gear 18 is interfaced to at least 2 teeth of the worm gear 16 to hold back a considerable force from an external device which tries to push in the mechanism and slide-bar. The interconnection between the helical gear 18 and the slide bar 8 is shown in FIGS. 1 thru 3*a* are representative of a variety of connections available. All known other crankshaft type of mechanisms are applicable to this type of drive.

Figure 3:
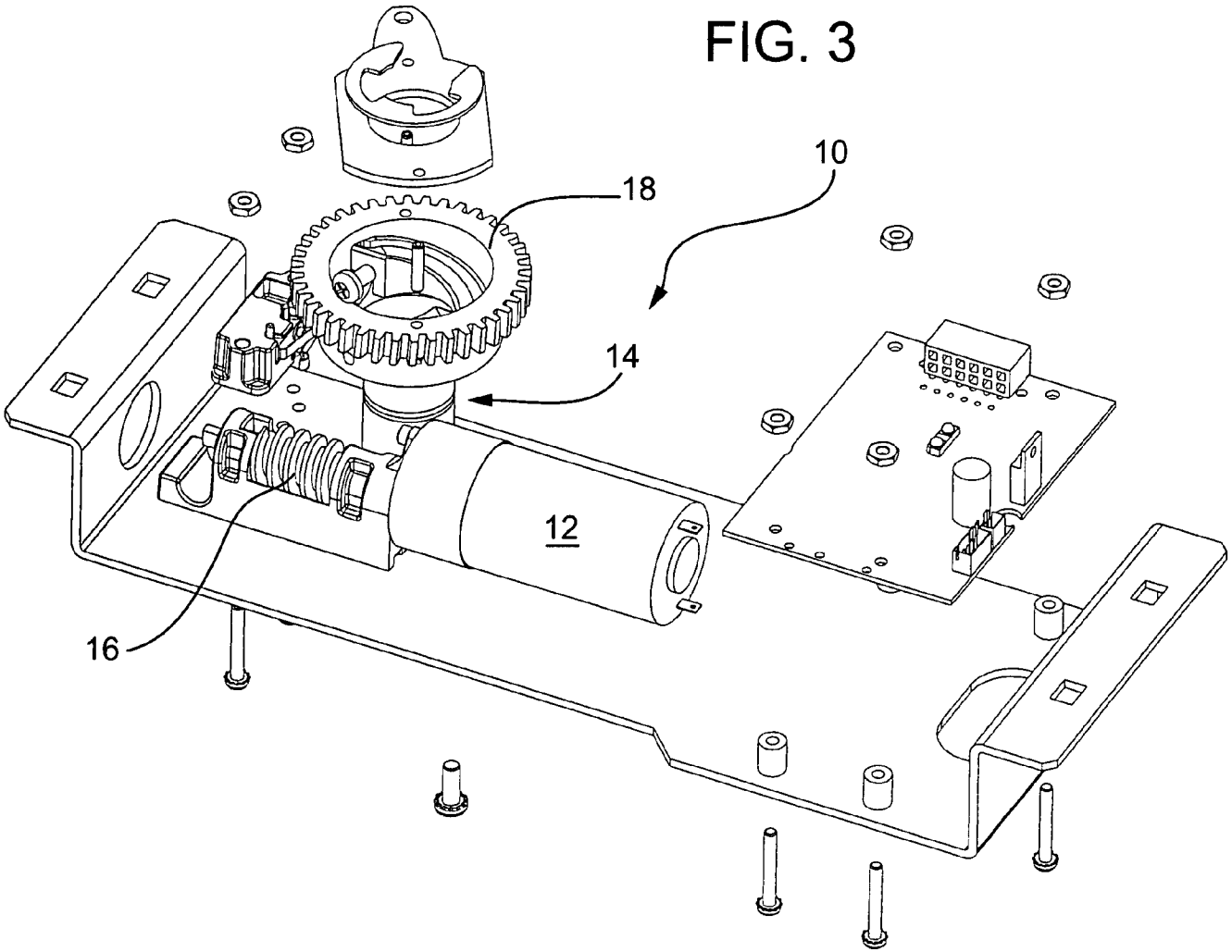
FIG. 3 is an exploded view of the motor and drive for the controlled slide-bar mechanism locking system.
Figure 3A:
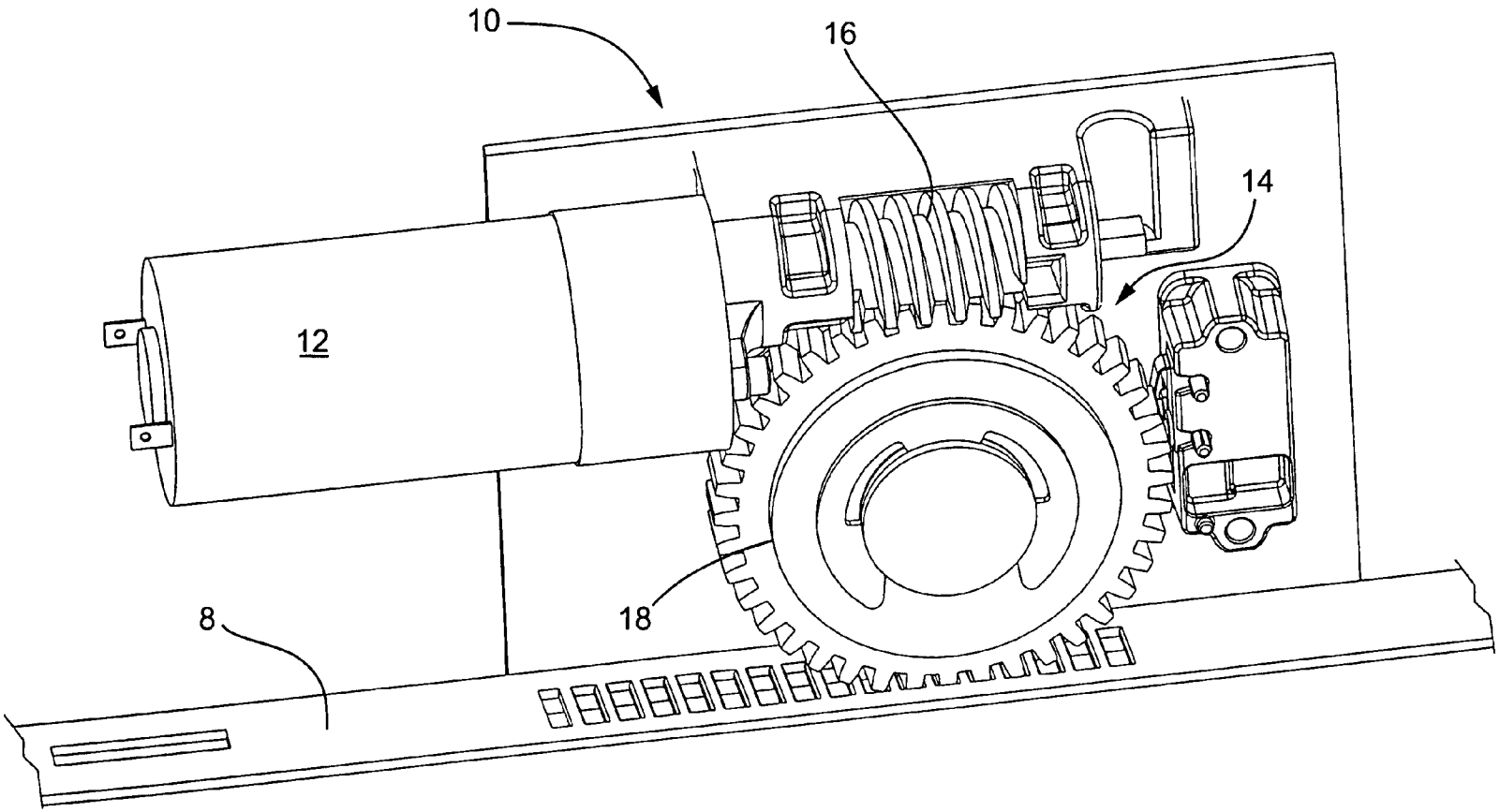
FIG. 3B is a perspective view of an alternate configuration of the mechanism showing a contained drive system.
Figure 3B:
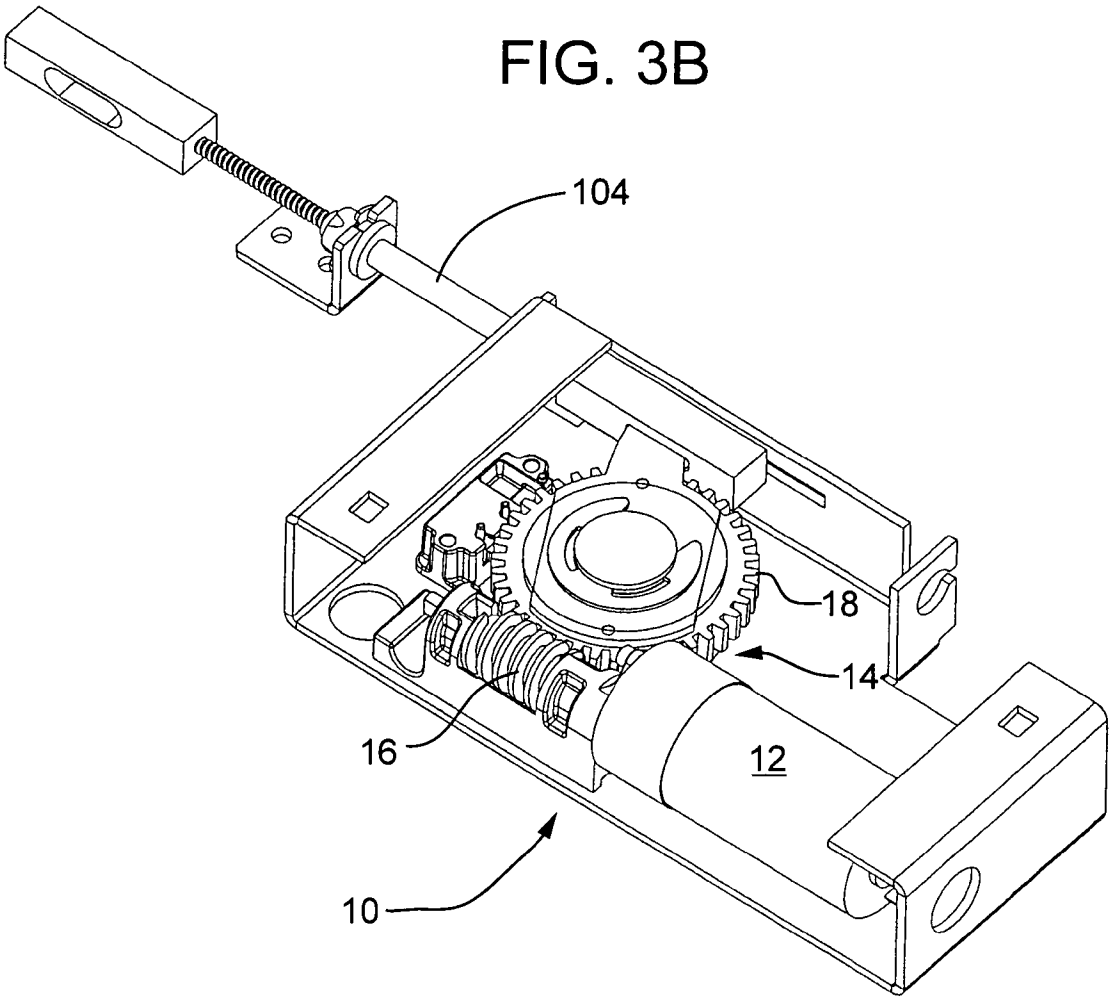
Figure 4:
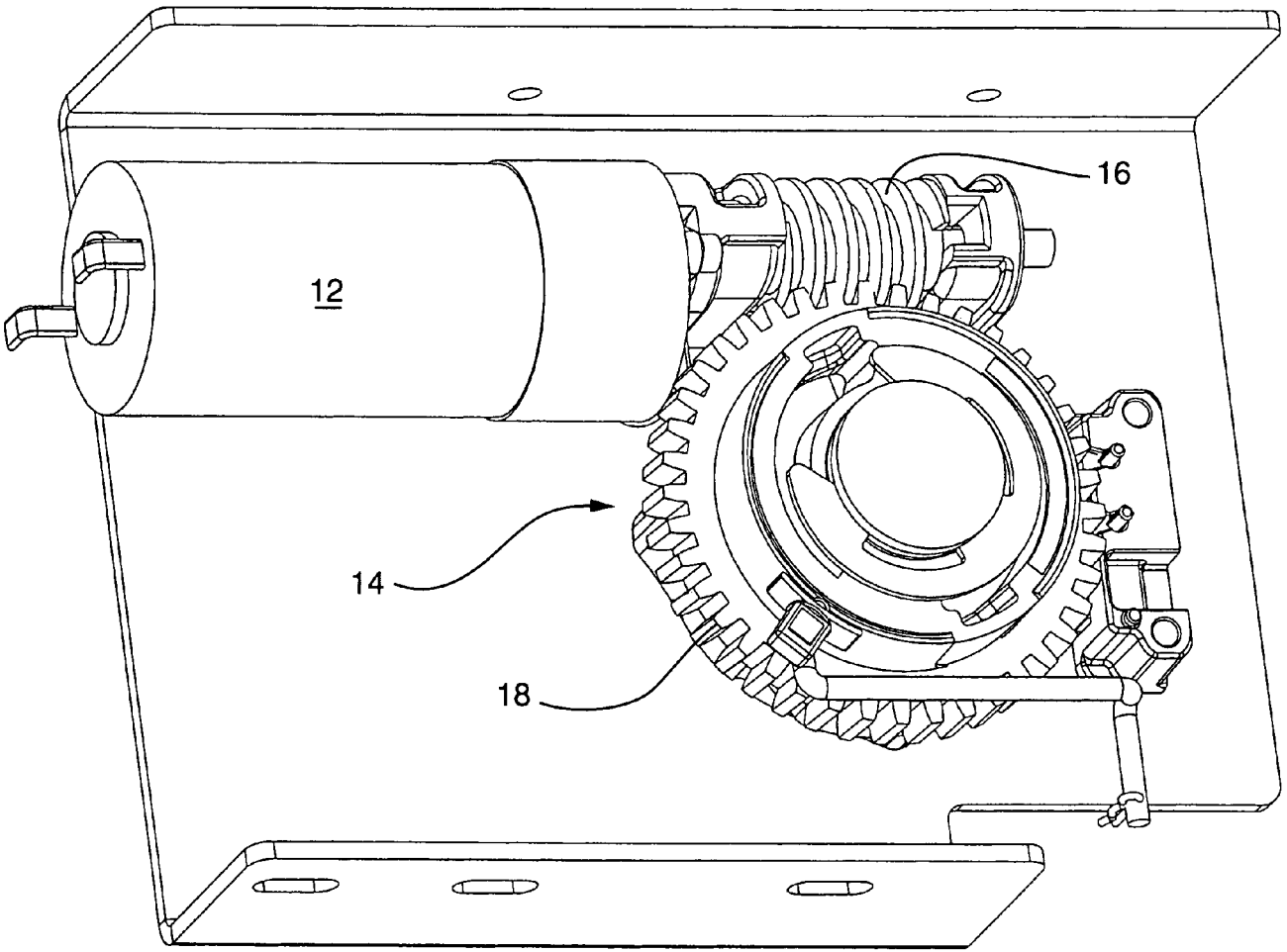
FIG. 4 is a perspective view showing a rod or wire interconnection.
Figure 5:
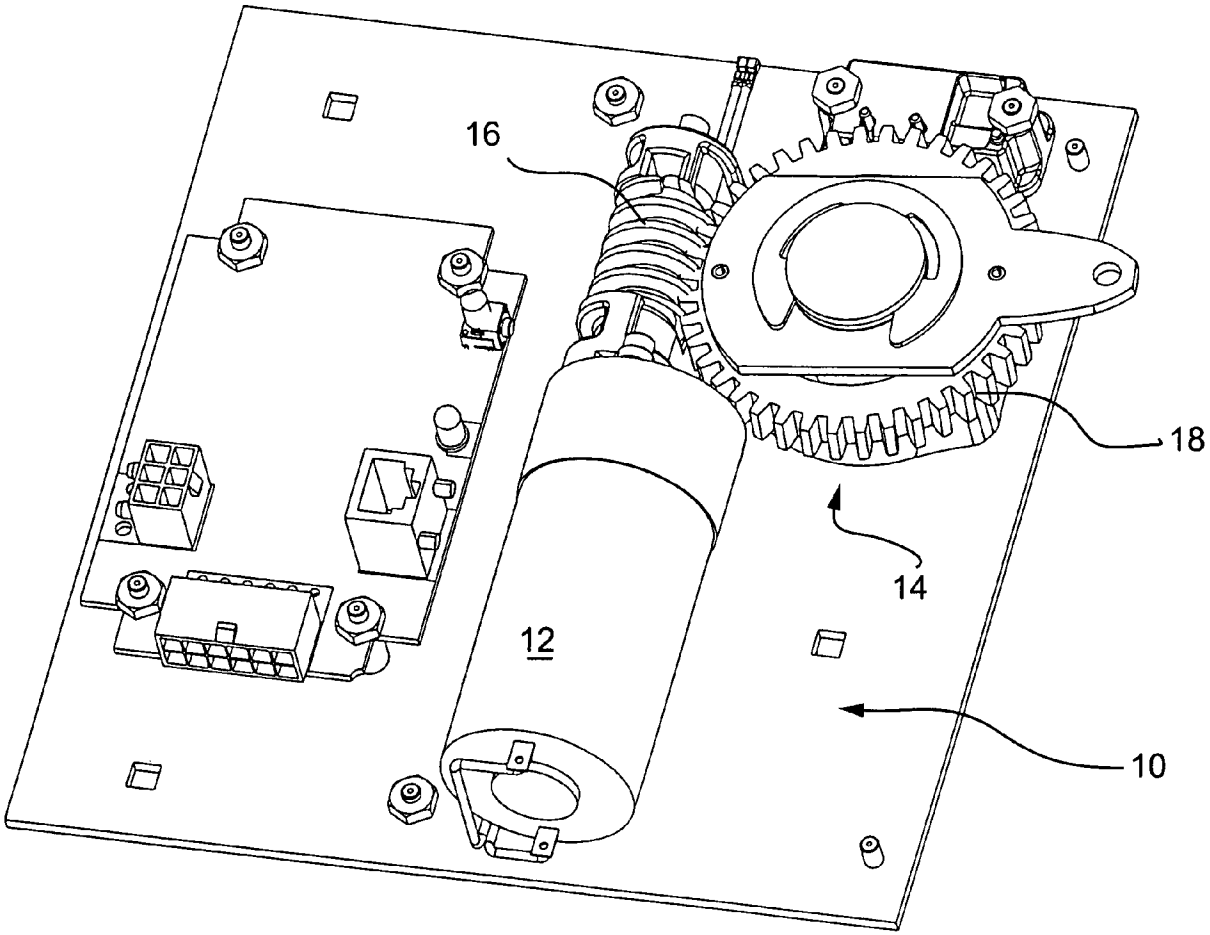
FIG. 5 is a perspective view showing yet another alternate construction and interconnection system as it would be typically installed into a vending machine.
Figure 6:
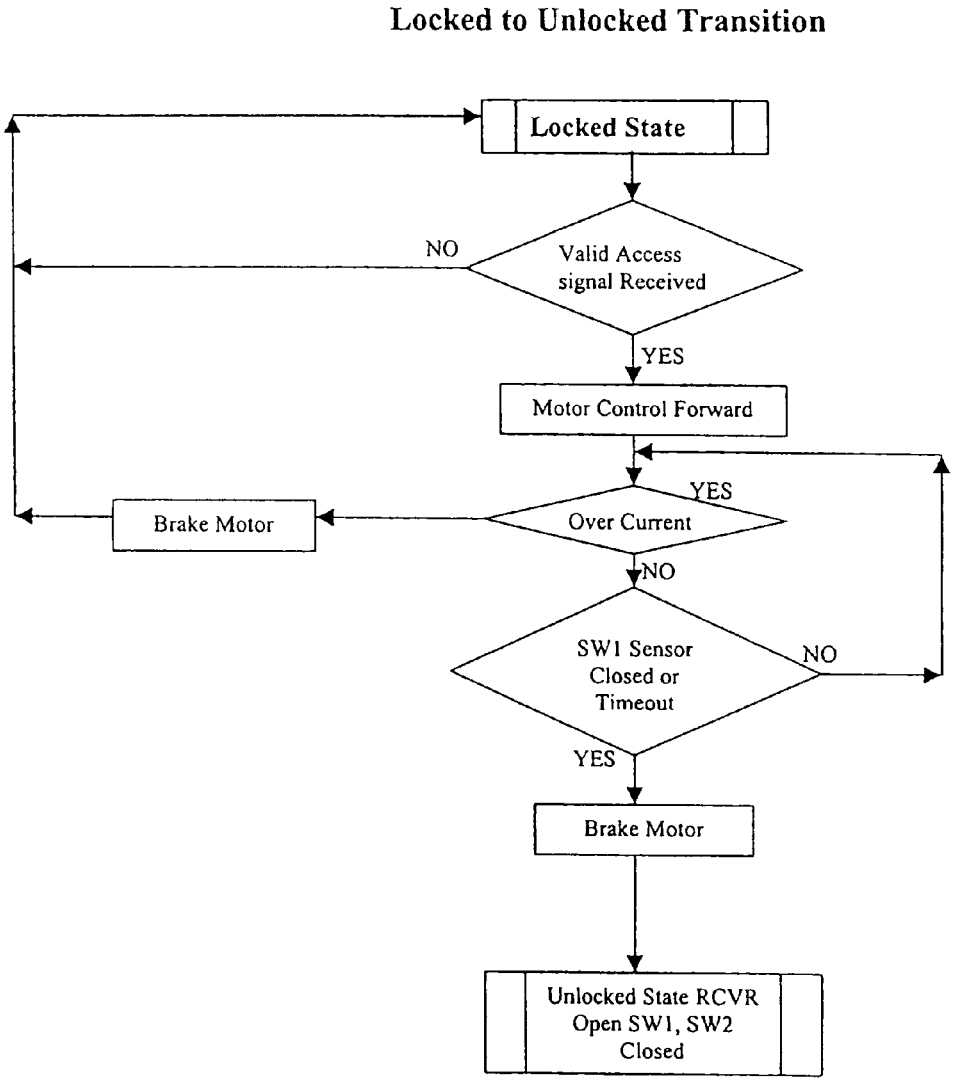
FIG. 6 is a flowchart of the locked to unlock operation.

The motor control can also interface into a cable or rod drive system 104 as shown in FIG. 3B. This type of drive allows the mechanism to be placed in a vending machine or the like in a variety of positions where space or direct access to the slide bars is not readily available. The rod as shown can be replaced using a conventional push—pull cable apparatus. The rod or cable assembly can be housed in such a manner as to allow the lock mechanism to be packaged as a singular assembly. This becomes an issue when trying to mount the lock drive unit in snack food vendors. These machines typically do not have access that allows direct connection from the crankshaft drive of the gear assembly, In accordance with the present invention, an electronic control 100 interfaces to the motor 12 and position switches 102 of the motor mechanism. It will control the mechanism by a microcomputer by either driving the mechanism motor in two directions (forward and reverse) or a single direction to move the slide-bars in and out of the locked position (retracted and extended). The flow-chart drawings 6 and 7 shows a mechanism control using forward/reverse motor control and position sensors. Both the locking and unlocking modes of operations are triggered by a signal from the access control device and the controller operates the motor per the sensor switches, motor current monitoring, and timers as described. The flow-chart drawings 8 & 9 describe locking and unlocking modes of operation if a door-closed and/or a receiver switch sensor is used to detect the door in the closed position to automatically trigger the locking sequence. As in FIGS. 6 & 7, the controller operates the motor per the sensor switches, motor current monitoring, and timers as described.

A further feature considers general safety of the lock operation, when the motor control unit attempts to energize the motor in order to move the slide-bar in either the locked or unlocked position and if either a slide-bar impediment or a door jam or a shorted motor condition occurs where the motor current crosses a certain limit to indicate the slide-bar is not moving, the motor control unit senses this condition and ceases to drive the motor. If this occurs at the beginning of the lock cycle (within approximately the first 30 degrees of gear rotation) the motor control unit will measure this and if it senses that the slide-bar is jammed from moving, the motor could be reversed in order to return the mechanism back to the fully retracted position. After 30 degrees of gear movement if the motor current is exceeded, the motor control will simply de-energize the motor and will not attempt to reverse the movement of the slide-bar, thus the enclosure door will remain in the locked position. If an unlock signal is later received, the motor controller will proceed to retract the slide-bar and unlock the vending machine.

In the event that a position switch is faulty, the controller is programmed with fault tolerant or default control logic to control the mechanism and allow the door to unlock if in fact a correct access code is received, even if the mechanism sensing is faulty.

Figure 7:
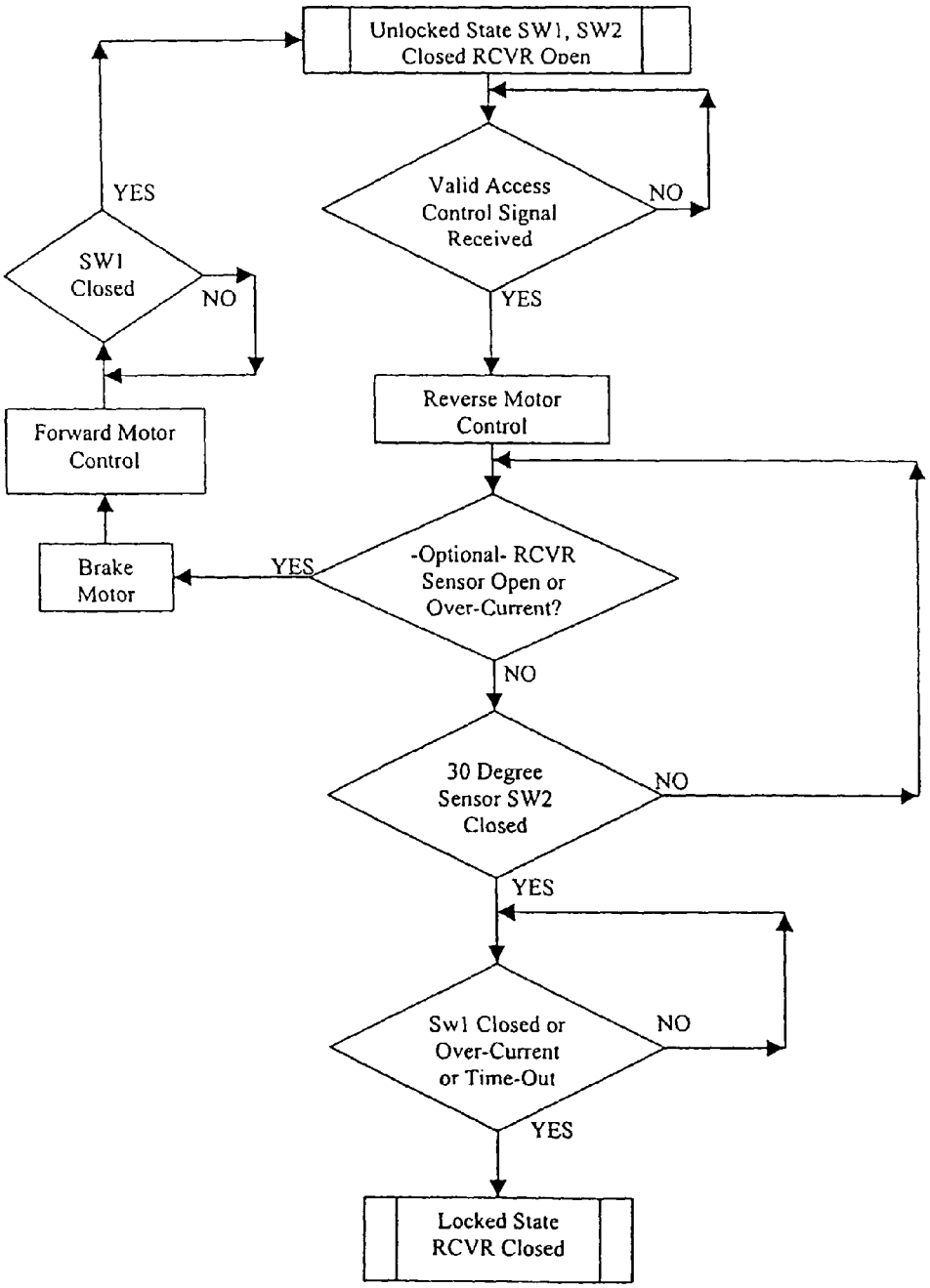
FIG. 7 is a flowchart of the unlock to lock operation.
Figure 8:
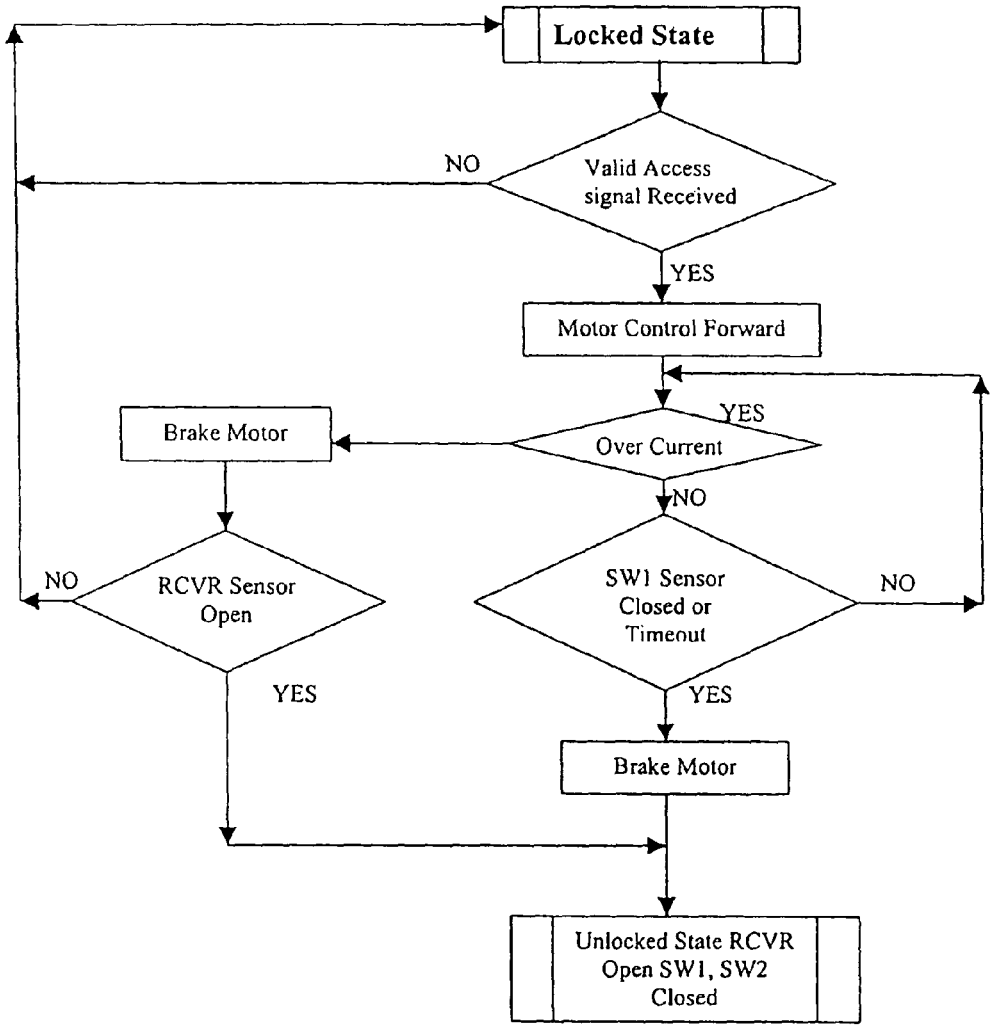
FIG. 8 is a flowchart of locked to unlocked with optional receiver sensor.
Figure 9:
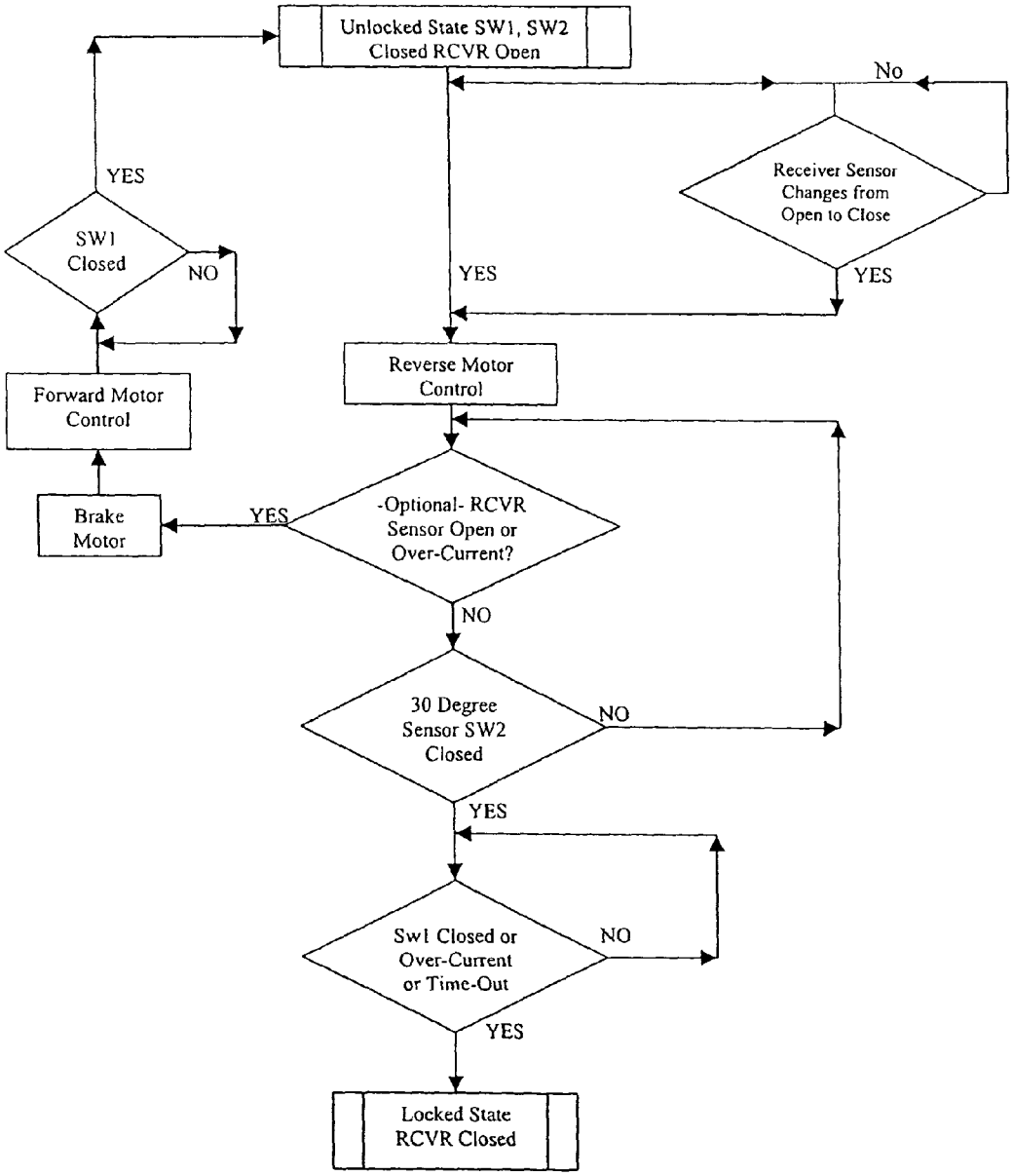
FIG. 9 is a flowchart of unlocked to locked with optional receiver sensor.
Figure 10:
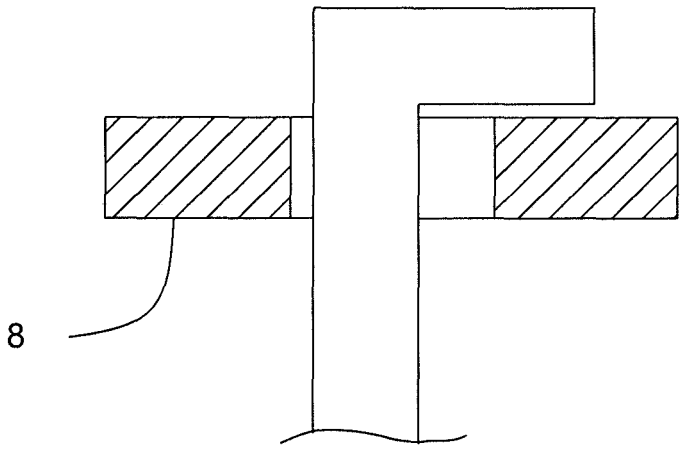
FIG. 10 is a representative illustration of a hook.

As described in FIG. 7, in the preferred embodiment the locking event for the vending machine door is controlled by an access signal from the access control unit. In an alternative embodiment as described in FIG. 9, locking is triggered by a simple position switch which measures the position of the door, which produces the lock trigger signal when the door moves from the open to the closed position. In all cases, the access control unit (when it receives a valid access code via a keypad or a remote unit) provides the trigger to unlock the slide-bar. Examples of keypad and remote controlled access control units are described in U.S. Pat. Nos. 5,617,082, 6,359, 547, and application number US2003/0234719A1.

In the case where a keypad lock mounted to the vending machine is used to access the motor control as described in the patent numbers above, the keypad lock will offer a simple user interface of keys (such as 12 access buttons) and LED lights and/or an LCD display to help the user enter access control commands, enter additional access codes, check the health of the battery, etc. Another alternative access control input may the vending machine selection buttons.

In the event an access control unit is desired that has no point of attack, a wireless remote control device may be used. Such a wireless access device is also described in U.S. Pat. No. 5,617,082, and this device also offers a battery-saver feature to reduce power consumption of the lock as it is waiting to receive an access code transmission. Two examples of wireless mediums used for this device are radio frequency and infrared. In radio frequency, the antenna of the access electronics must be in range of where the remote transmitter is used. In infrared, the infrared pin diode must be in optical range of where the remote transmitter is used. This battery saver feature can be utilized in a number ways: a) full-time when batteries are used to power the lock; b) not at all when the power to the lock is a DC power source; c) a combination of the two modes, wherein power saver mode is used when it is not expected that the lock will be immediately accessed or re-locked, and full-power mode when it is expected that the lock may be immediately accessed or re-locked. One less desirable feature of the battery saver feature is a time-delay reaction to the lock/unlock access input. The advantage to the dual mode of operation is to take advantage of the power-saver during the long time periods the lock most likely is not being locked or unlocked, and to take advantage of the full power mode to react the fastest to the lock/unlock access control signal.

The wireless access control device may take on one of many forms, such as a remote transmitter with a single access code transmit button. When the single transmitter button is pressed, the complete access code is instantly transmitted to the access control receiver, such as described in application US2003/0234719A1. Or alternately, the wireless device may use a biometric input such as fingerprint ID to replace a single button as the interface device.

The remote unit can also be a unit with several keypad buttons made up of several digits (for example, 0-9) to allow a user to enter multiple number of button input combinations to make up an access code. As each button is pressed, an individual unique code representing that button is transmitted to the access control unit. The order and combination of the codes received from the remote make up the access code for the vending machine. An example of such a device is known as a universal remote control unit for a television and/or other consumer electronics. Such units typically contain a 0-9 keypad; in these devices each key press results in a unique code transmission. The combination and order of the button presses (for example, 5 presses consisting of 1-3-5-7-9) will make up a unique access code transmission to the access control unit.

In the example above using the universal remote control unit, a problem exists with annunciation and user friendly operation of the lock. For example, the universal remote typically contains only an LED light indicating a button was pressed and a code was transmitted, but there is no consideration or confirmation that such key press of a particular code was received by the access control unit. Thus, this invention offers two possible solutions to this problem.

1. The access control unit can contain annunciation such as LED lights, an LCD display or an audio annunciator (just for a few examples) to provide feedback for the user as to exactly how many keypresses are being received by the remote transmitter. Note, these annunciations do not give any positive or negative feedback of whether the code received was valid or invalid, only that it was received. It will also attempt to annunciate the order that each code is received. For example, if the expected code is 5 digits in length, the annunciator may attempt to either light or un-light an LED for each code received, providing both feedbacks that the code was received and what receiving sequence this code was in as it was received. Typically, this annunciation would be located such that it can be viewed from just in front of the door (from 0 to 10 feet back from the door). In addition, other messages may be displayed such as the complete correct code was received, an incorrect complete code was received, the battery is low, an incorrect button was pressed, the mechanism should be unlocking, etc.

2. The access control unit can contain a transmission system (typically the same transmission medium as the remote unit) and the remote transmission unit can contain a wireless receiver system to receive the annunciation messages from the access control unit. The same annunciation components such as LED's, LCD, and/or audio indicators can be used at the remote unit. Thus, the user would transmit a code via the control unit, if received the access control would transmit back a confirmation to the remote unit, the remote unit will display an annunciation message to the user that the code was received. In addition, other messages may be displayed such as the complete correct code was received, an incorrect complete code was received, the battery is low, an incorrect button was pressed, the mechanism should be unlocking, etc.

This lock system can be power either by battery source or an AC or DC power source. If batteries are used, it is assumed they are mounted inside the enclosure and not accessible while the door is locked. The batteries shall be monitored for their health and the health will be measured and annunciated to the user as the enclosure is being accessed or locked (also described in U.S. Pat. No. 6,359,547). The batteries will usually be alkaline non-recharge type, although rechargeable types are possible to use.

In the event the batteries are to low to operate the unit, the preferred embodiment has a power input port that will accept a back-up power supply source to power the lock to allow the lock mechanism to unlock if a correct access code is received. This port does not provide a hotwire to over-ride the access control system of the lock. Once such battery-back-up unit is described in TriTeq U.S. patent application Ser. No. 60/523,505. Or, in some cases it may be possible to use a simple 9-volt battery.

The lock also provides an over-ride system in case the electronics fails (either the access control or the motor control unit) by providing access to the motor wires if the enclosure is drilled in a certain location. Once gaining access to these wires, the motor can be energized independent of the access control and motor control circuits and the slide-bar will retract so the door can be opened. This will allow the faulty lock components replacement without serious damage of the enclosure primary structure.

What is claimed:

1. A locking system for a cabinet having a door capable of being locked and unlocked to the cabinet and the door capable of movement between an open position and a closed position, the locking system comprising:

a motor having an energized state and a de-energized state, the motor carried by one of either the door or the cabinet, said motor being connected to at least one gear, the at least one gear being disposed to move a slide bar for substantially vertical and substantially linear locking and unlocking engagement with the other of the door or the cabinet, the other of the door or the cabinet in one of a locked position and an unlocked position when the motor is in the energized state, the motor connected to the slide bar through the connection with the at least one gear when the motor is in the energized state and the de-energized state, the slide bar having a slide bar locked position and a slide bar unlocked position, an access means including an access control receiver, and a controller interfaced with the motor for initiating said motor to drive, via the at least one gear, movement of the slide bar between the slide bar locked position and the slide bar unlocked position, wherein, the motor initiates an unlocking process to move the slide bar from the slide bar locked position to the slide bar unlocked position when an access signal is received, and the motor initiates a locking process to move the slide bar from the slide bar unlocked position to the slide bar locked position when the controller receives a signal to indicate the door is placed in the closed position.

2. A locking system as claimed in claim 1, wherein said motor is a two-directional reversible motor.

3. A locking system as claimed in claim 1, further including a plurality of gears configured as a gear reduction system, wherein the at least one gear is a first gear of the plurality of gears.

4. A locking system as claimed in claim 3, wherein the first gear is a helical gear.

5. A locking system as claimed in claim 4, in which the plurality of gears includes a second gear, and the second gear is worm gear having a plurality of teeth.

6. A locking system as claimed in claim 5, wherein said helical gear is interfaced to at least two teeth of the worm gear.

7. A locking system as claimed in claim 1, including an override for energizing said motor independent of said controller and access means.

8. A locking system as claimed in claim 1, wherein the controller and motor are powered by a battery source.

9. A locking system as claimed in claim 1, wherein a position switch provides the signal that energizes said motor to place the slide bar in the locked position, the signal indicative of the door placed in the closed position.

10. A locking system as claimed in claim 1, wherein said access control receiver receives the access signal from a wireless control device.

11. A locking system as claimed in claim 1, further comprising a sensor for said motor to detect motor current and either reverse a motor direction or de-energize the motor upon reaching a predetermined current level.

12. A locking system as claimed in claim 1, wherein the controller is operable only when a unique present access code signal is received by the access control receiver.

13. A locking system as claimed in claim 1, wherein said access means includes a battery saver sleep mode and an operational mode upon receipt of the access signal.

14. A locking system as claimed in claim 1, further comprising a plurality of latch means engagable for the slide bar locked and slide bar unlocked positions.

15. A locking system as claimed in claim 14, wherein said latch means includes hook and slot type latches.

16. A locking system as in claim 1 wherein the motor moves the slide bar with a rod.

17. A locking system as in claim 1 wherein the at least one gear directly engages the slide bar to move the slide bar.

18. A locking system as claimed in claim 1, wherein the at least one gear is disposed to move the slide bar for exclusively vertical and linear locking and unlocking engagement with the other of the door or the cabinet.

19. The locking system as claimed in claim 1, wherein the motor operates to move the slide bar to the slide bar unlocked position following a door-open position detection.

20. The locking system as claimed in claim 1, wherein a door-open detection to discontinue the motor operation is limited to take place before the slide bar is in the slide bar locked position.

21. The locking system as claimed in claim 1, wherein the motor discontinues operation to move the slide bar from the slide bar unlocked position to the slide bar locked position upon the controller receiving a door-open position detection during the locking process.

22. A method of unlocking and locking a door to a cabinet, the door having an open position and a closed position, the method comprising the steps of:

providing a motor with an electronic motor controller, the motor having an energized state and a de-energized state, the motor connected to a mechanical linkage, the motor configured to drive the mechanical linkage which is connected to a slide, the mechanical linkage configured to move the slide between a slide locked position and a slide unlocked position, the motor connected to the slide through the connection with the mechanical linkage when the motor is in the energized state and the de-energized state, the door in one of a locked position and an unlocked position when the motor is in the energized state, providing an access control receiver electronically coupled to the electronic motor controller, receiving at the access control receiver, an access signal, powering said motor in response to the step of receiving, to drive the linkage, thereby moving the slide substantially vertically and substantially linearly, discontinuing operation of the motor to unlock the door upon the controller receiving a position detection or an over-current detection during the unlocking process, detecting a signal to indicate that the door is placed in the closed position; and powering the motor in response to the step of detecting that the door is placed in the closed position to drive the linkage substantially vertically and substantially linearly.

23. A method as claimed in claim 22, including providing a microcomputer means for directing operation of said electronic motor controller and motor.

24. A locking system as claimed in claim 22, further comprising a plurality of latch means engagable for the slide lock and slide unlock positions.

25. The method as claimed in claim 22, further comprising the step of operating the motor to move the slide to the unlocked position following a door-open position detection.

26. The method of unlocking and locking a door to a cabinet as described in claim 22, further comprising the step of detecting a signal to indicate the door has opened and, in response thereto, discontinuing operation of driving the linkage.

27. A locking system for a cabinet having a door capable of being locked and unlocked to the cabinet on which the door is pivotally mounted and the door being capable of movement between an open position and a closed position, the locking system comprising:

a slide carried by one of either the door or the cabinet, the slide capable of substantially vertical and substantially linear movement between a slide locked position and a slide unlocked position, a mechanical linkage coupled to and configured to move the slide between the slide locked position and the slide unlocked position, an access controller including an access control receiver, a motor having an energized state and a de-energized state, the motor connected to the mechanical linkage and configured to drive the mechanical linkage, the motor connected to the slide through the connection with the mechanical linkage when the motor is in the energized state and the de-energized state, the door in one of a locked position and an unlocked position when the motor is in the energized state, and a motor control for operating the motor to drive the mechanical linkage to move the slide between the slide locked and slide unlocked positions, wherein, the motor operates to drive the linkage and move the slide to the slide unlocked position when the access controller receives an access signal, the motor discontinues operation to drive the linkage and move the slide to the slide unlocked position upon the controller receiving at least one of a timeout detection, a position detection or an over-current detection during the unlocking process, and, the motor operates to drive the linkage and move the slide from the slide unlocked position to the slide locked position when the door is placed in the closed position.

28. A locking system as claimed in claim 27, wherein said mechanical linkage is rotatably connected to said motor.

29. A locking system as claimed in claim 27, wherein said motor is configured to operate in two directions to move the slide, the first direction is a forward direction and the second direction is a reverse direction.

30. A locking system as claimed in claim 27, wherein the electronic motor includes a microcomputer for directing operation of said motor.

31. A locking system as claimed in claim 27, wherein said slide comprises a push-pull cable.

32. A locking system as claimed in claim 27, wherein said slide comprises a push-pull rod.

33. A locking system as claimed in claim 27, wherein said mechanical linkage and said slide is gear driven.

34. A locking system as claimed in claim 27, further comprising a plurality of latch means engagable for the slide lock and slide unlock positions.

35. The locking system as claimed in claim 27, wherein the motor operates to move the slide to the slide unlocked position following a door-open position detection.

36. The locking system as claimed in claim 27, wherein a door-open detection to discontinue the motor operation is limited to take place before the slide is in the slide bar locked position.

37. The locking system as described in claim 27, wherein the motor discontinues operation to drive the linkage and move the slide to the slide locked position upon the controller receiving a door open position detection during the locking process.

38. A method of locking and unlocking a door to a cabinet, the door having an open position and a closed position, and one of either the door or the cabinet having a rotational force generating means responsive to an access control receiver and connected to a mechanical force conversion means which is connected to a latch mechanism, the rotational force generating means having an energized state and a de-energized state, the rotational force generating means connected to the latch mechanism through the connection with the mechanical force conversion means when the rotational force generating means is in the energized state and the de-energized state, the door in one of a locked position and an unlocked position when the rotational force generating means is in the energized state, the method comprising the steps of:

providing the rotational force generating means carried by either the door or the cabinet to create a rotational force in response to one of either:

an access signal received by the access control receiver, or a signal indicating one of either the door is to be locked or the door is in the closed position, converting the rotational force to a drive force through operation of the mechanical force conversion means, and moving the latch mechanism to one of either a latch locked position or a latch unlocked position, wherein at least one detection signal detected prior to the latch mechanism reaching the latch locked position is a signal that indicates that the door is jammed or the latch mechanism is jammed.

39. The method as claimed in claim 38 wherein at least one detection signal detected prior to the latch mechanism reaching the latch locked position is sensed prior to the rotational force generating means reaching 30 degrees of rotation.

40. The method as claimed in claim 38 wherein the rotational force generating means switches from a forward direction to a reverse direction before completing a locking process when at least one detection signal is detected.

41. The locking system of claim 38, wherein the rotational force generating means discontinues operation to lock the door upon detecting at least one detection signal prior to the latch reaching the latch locked position during a locking process, and the rotational force generating means moves the latch mechanism to the latch unlocked position after the at least one detection signal is detected.

42. A method of unlocking and locking a door to a cabinet, the door having an open position and a closed position and one of either the door or the cabinet having a rotational force generating means responsive to an access control receiver and connected to a mechanical force conversion means which is connected to a latch mechanism, the rotational force generating means having an energized state and a de-energized state, the rotational force generating means connected to the latch mechanism through the connection with the mechanical force conversion means when the rotational force generating means is in the energized state and the de-energized state, the door in one of a locked position and an unlocked position when the rotational force generating means is in the energized state, the method comprising the steps of:

initiating operation of the rotational force generating means carried by one of either the door or the cabinet to create a rotational force in response to one of either:

an access signal received by the access control receiver, or a signal indicating one of either the door is to be locked or the door is in the closed position, converting the rotational force to a linear drive force through operation of the mechanical force conversion means, and moving the latch mechanism to one of either a latch locked position or a latch unlocked position, wherein a door open detection signal is sensed when the door is jammed or the latch mechanism is jammed.

43. The method of unlocking and locking a door to a cabinet as claimed in claim 42, further comprising the step of operating the rotational force generating means to move the latch mechanism to the latch unlocked position following a door-open position detection.

44. The method of unlocking and locking a door to a cabinet as claimed in claim 42 wherein a door open detection signal is sensed prior to the rotational force generating means reaching 30 degrees of rotation.

45. The method of unlocking and locking a door to a cabinet as claimed in claim 42 wherein the rotational force generating means switches from a forward direction to a reverse direction before completing the locking process when at least one detection signal is detected.

46. The method of unlocking and locking a door to a cabinet as described in claim 42, further comprising the step of discontinuing operation of the rotational force generating means to lock the door upon a door-open position detection during a locking process.

* * * * *